US011708992B2

(12) United States Patent
Kimura et al.

(10) Patent No.: US 11,708,992 B2
(45) Date of Patent: Jul. 25, 2023

(54) AIR CONDITIONING CONTROL SYSTEM AND AIR CONDITIONER

(71) Applicant: MITSUBISHI ELECTRIC CORPORATION, Tokyo (JP)

(72) Inventors: Aki Kimura, Tokyo (JP); Yuka Tsuda, Tokyo (JP); Tetsuro Shida, Tokyo (JP); Masataka Baba, Tokyo (JP); Satoko Miki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 518 days.

(21) Appl. No.: 16/962,957

(22) PCT Filed: Jan. 31, 2018

(86) PCT No.: PCT/JP2018/003073
§ 371 (c)(1),
(2) Date: Jul. 17, 2020

(87) PCT Pub. No.: WO2019/150457
PCT Pub. Date: Aug. 8, 2019

(65) Prior Publication Data
US 2020/0340703 A1 Oct. 29, 2020

(51) Int. Cl.
*F24F 11/74* (2018.01)
*F24F 11/79* (2018.01)

(52) U.S. Cl.
CPC ..... *F24F 11/74* (2018.01); *F24F 11/79* (2018.01)

(58) Field of Classification Search
CPC .. F24F 11/74; F24F 11/79; F24F 11/62; F24F 2110/40; F24F 11/56
See application file for complete search history.

(56) References Cited

U.S. PATENT DOCUMENTS

2003/0040269 A1* 2/2003 Yokoyama ..... H01L 21/67253 454/52
2014/0099872 A1* 4/2014 Matsumoto ..... F24F 11/0001 454/229

(Continued)

FOREIGN PATENT DOCUMENTS

JP 62-252841 A 11/1987
JP 2003-279115 A 10/2003

(Continued)

*Primary Examiner* — Nelson J Nieves
(74) *Attorney, Agent, or Firm* — Birch, Stewart, Kolasch & Birch, LLP

(57) ABSTRACT

An air conditioning control system includes: an air pressure measurement unit (111) configured to measure an air pressure value; an air conditioning unit (136) whose wind direction and airflow volume are changeable; a wind velocity calculation unit (132) configured to calculate a wind velocity of wind received by a portable terminal (110) from a variation in a plurality of atmospheric pressure values and to specify a presence direction that is a direction in which the portable terminal (110) is present with respect to the air conditioner (130); an air conditioning control determination unit (134) configured to determine a wind direction and an airflow volume of the air conditioning unit (136) in accordance with the wind velocity and the presence direction; and an air conditioning control unit (135) configured to control the air conditioning unit (136) so that the determined wind direction and airflow volume are obtained.

10 Claims, 8 Drawing Sheets

(56) References Cited

U.S. PATENT DOCUMENTS

| | | | | |
|---|---|---|---|---|
| 2016/0069579 | A1 | 3/2016 | Yabunouchi et al. | |
| 2016/0278696 | A1* | 9/2016 | Ishibashi | A61B 5/7278 |
| 2016/0363340 | A1* | 12/2016 | Shikii | B60H 1/00742 |
| 2018/0215233 | A1* | 8/2018 | Neveu | H04N 23/11 |
| 2018/0306456 | A1* | 10/2018 | Subban | F24F 13/08 |

FOREIGN PATENT DOCUMENTS

| | | | |
|---|---|---|---|
| JP | 2013-36647 | A | 2/2013 |
| WO | WO 2014/167837 | A1 | 10/2014 |

* cited by examiner

AIR CONDITIONING CONTROL SYSTEM AND AIR CONDITIONER

TECHNICAL FIELD

The present invention relates to an air conditioning control system and an air conditioner.

BACKGROUND ART

Conventionally, to make an indoor environment comfortable with an air conditioner, indoor and outdoor environments are measured so that control is performed in accordance with the environments. The indoor environment is generally obtained by measurement with a sensor mounted on an indoor unit. The outdoor environment is obtained by measurement with a sensor mounted on an outdoor unit, measurement with a dedicated environment measuring device, or collecting observation data from a meteorological station through the Internet.

Patent Reference 1, for example, discloses an air conditioning system including an opening/closing device for a window or a door, a monitoring device for monitoring an environment inside or outside a building, and a controller. In this air conditioning system, the monitoring device measures a wind velocity and a wind direction by a sensor, and the controller controls the air conditioner based on a measurement result of the monitoring device.

PRIOR ART REFERENCE

Patent Reference

Patent Reference 1: International Patent Publication No. 2014/167837

SUMMARY OF THE INVENTION

Problem to be Solved by the Invention

It is, however, difficult for an air conditioner to set any indoor place in an environment desired and intended by a user. Specifically, since the air conditioner is controlled based on values measured by a sensor, the air conditioner sets, in a preferable environment, a place where the sensor is placed. Thus, in a case where no sensor is placed in such a place intended by a user as the periphery of the user, a place intended by the user cannot be set comfortable.

It is therefore an object of one or more aspects of the present invention to make a place intended by a user more preferable by using an air conditioner.

Means of Solving the Problem

An air conditioning control system according to a first aspect of the present invention has a portable terminal including an air pressure measurement unit configured to measure an air pressure value and an air conditioner including an air conditioning unit whose wind direction and airflow volume are changeable. The air conditioning control system includes: a wind velocity calculation unit configured to calculate a wind velocity of wind received by the portable terminal from a variation in a plurality of air pressure values measured by the air pressure measurement unit, and to specify a presence direction, the presence direction being a direction in which the portable terminal is present with respect to the air conditioner; an air conditioning control determination unit configured to determine a wind direction and an airflow volume of the air conditioning unit in accordance with the wind velocity and the presence direction; and an air conditioning control unit configured to control the air conditioning unit so that the determined wind direction and the determined airflow volume are obtained.

An air conditioning control system according to a second aspect of the present invention has a portable terminal including an air pressure measurement unit configured to measure an air pressure value, a temperature measurement unit configured to measure a temperature, and a humidity measurement unit configured to measure a humidity, and an air conditioner including an air conditioning unit whose wind direction and airflow volume are changeable. The air conditioning control system includes: a wind velocity calculation unit configured to calculate a wind velocity of wind received by the portable terminal from a variation in a plurality of air pressure values measured by the air pressure measurement unit, and to specify a presence direction, the presence direction being a direction in which the portable terminal is present with respect to the air conditioner; an air conditioning control determination unit configured to specify a sensible temperature of a user of the portable terminal from the wind velocity, the temperature, and the humidity, and to determine a wind direction and an airflow volume of the air conditioning unit in accordance with the sensible temperature and the presence direction; and an air conditioning control unit configured to control the air conditioning unit so that the determined wind direction and the determined airflow volume are obtained.

An air conditioning control system according to a third aspect of the present invention has a portable terminal including a sound collector configured to output an output value indicating a noise amount and an air conditioner including an air conditioning unit whose wind direction and airflow volume are changeable. The air conditioning control system includes: a wind velocity specifying unit configured to specify a wind velocity of wind received by the portable terminal from a variation of a plurality of output values output from the sound collector, and to specify a presence direction that is a direction in which the portable terminal is present with respect to the air conditioner; an air conditioning control determination unit configured to determine a wind direction and an airflow volume of the air conditioning unit in accordance with the wind velocity and the presence direction; and an air conditioning control unit configured to control the air conditioning unit so that the determined wind direction and airflow volume is obtained.

An air conditioner according to a first aspect of the present invention is an air conditioner configured to communicate with a portable terminal including an air pressure measurement unit, the air pressure measurement unit being configured to measure an air pressure value. The air conditioner includes: an air conditioning unit whose wind direction and airflow volume are changeable;

an air conditioning communication unit configured to receive an air pressure value from the portable terminal by communicating with the portable terminal; a wind velocity calculation unit configured to calculate a wind velocity of wind received by the portable terminal from a variation in a plurality of air pressure values received by the air conditioning communication unit, and to specify a presence direction that is a direction in which the portable terminal is present with respect to the air conditioner; an air conditioning control determination unit configured to determine a wind direction and an airflow volume of the air conditioning unit in accordance with the wind velocity and the presence direction; and an air conditioning control unit configured to control the air conditioning unit so that the determined wind direction and airflow volume are obtained.

An air conditioner according to a second aspect of the present invention is an air conditioner configured to communicate with a portable terminal, the portable terminal including an air pressure measurement unit configured to measure an air pressure value, a temperature measurement unit configured to measure a temperature, and a humidity measurement unit configured to measure a humidity. The air conditioner includes: an air conditioning unit whose wind direction and airflow volume are changeable; an air conditioning communication unit configured to receive an air pressure value, a temperature, and a humidity from the portable terminal by communicating with the portable terminal; a wind velocity calculation unit configured to calculate a wind velocity of wind received by the portable terminal from a variation in a plurality of air pressure values received by the air conditioning communication unit, and to specify a presence direction that is a direction in which the portable terminal is present with respect to the air conditioner; an air conditioning control determination unit configured to specify a sensible temperature of a user of the portable terminal from the wind velocity, the temperature, and the humidity, and to determine a wind direction and an airflow volume of the air conditioning unit in accordance with the sensible temperature and the presence direction; and an air conditioning control unit configured to control the air conditioning unit so that the determined wind direction and airflow volume are obtained.

An air conditioner according to a third aspect of the present invention is an air conditioner configured to communicate with a portable terminal, the portable terminal including a sound collector configured to output an output value indicating a noise amount. The air conditioner includes: an air conditioning unit whose wind direction and airflow volume are changeable; an air conditioning communication unit configured to receive an output value from the portable terminal by communicating with the portable terminal; a wind velocity specifying unit configured to specify a wind velocity of wind received by the portable terminal from a variation in a plurality of output values received by the air conditioning communication unit, and to specify a presence direction that is a direction in which the portable terminal is present with respect to the air conditioner;

an air conditioning control determination unit configured to determine a wind direction and an the airflow volume of the air conditioning unit in accordance with the wind velocity and the presence direction; and an air conditioning control unit configured to control the air conditioning unit so that the determined wind direction and airflow volume are obtained.

Effects of the Invention

According to one or more aspects of the present invention, it is possible to set a placed intended by a user more preferable by using an air conditioner.

MODE FOR CARRYING OUT THE INVENTION

First Embodiment

Figure 1:
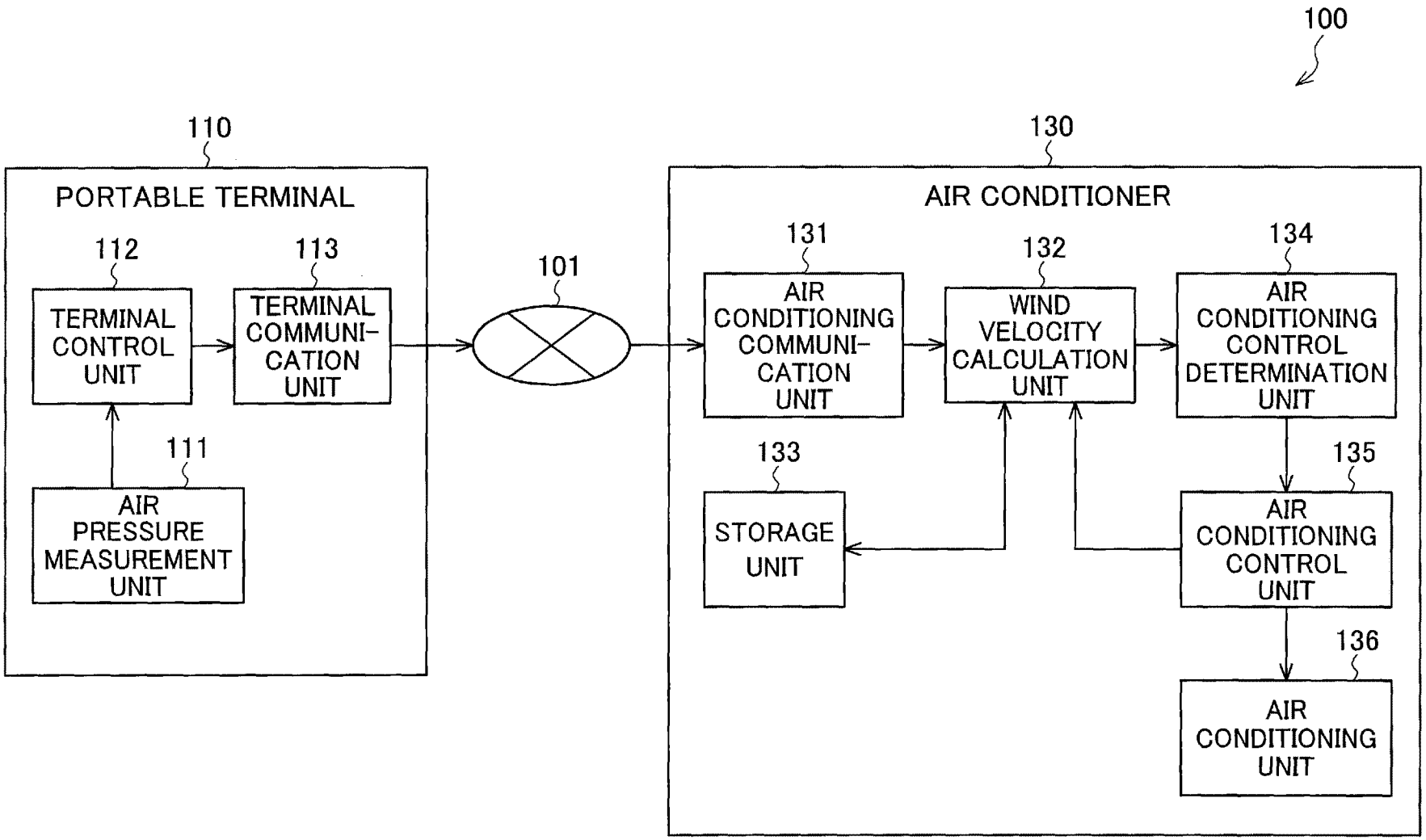
FIG. 1 is a block diagram schematically illustrating a configuration of an air conditioning control system according to a first embodiment.

FIG. 1 is a block diagram schematically illustrating a configuration of an air conditioning control system 100 according to a first embodiment.

The air conditioning control system 100 includes a portable terminal 110 and an air conditioner 130.

The portable terminal 110 and the air conditioner 130 are connected to a network 101 such as a local area network (LAN). For example, communication in the network 101 is wireless communication, such as wireless LAN, Wi-Fi (registered trademark), or Bluetooth (registered trademark).

The portable terminal 110 includes an air pressure measurement unit 111, a terminal control unit 112, and a terminal communication unit 113.

The air pressure measurement unit 111 measures an air pressure value. For example, the air pressure measurement unit 111 can be implemented by an air pressure sensor for measuring an air pressure.

The terminal control unit 112 controls processing in the portable terminal 110. For example, the terminal control unit 112 receives a measured air pressure value from the air pressure measurement unit 111, and gives the received air pressure value to the terminal communication unit 113.

The terminal communication unit 113 communicates with the network 101. For example, the terminal communication unit 113 transmits an air pressure value given by the terminal control unit 112, to the air conditioner 130. The terminal communication unit 113 can be implemented by, for example, a network interface card (NIC).

Figure 2A:
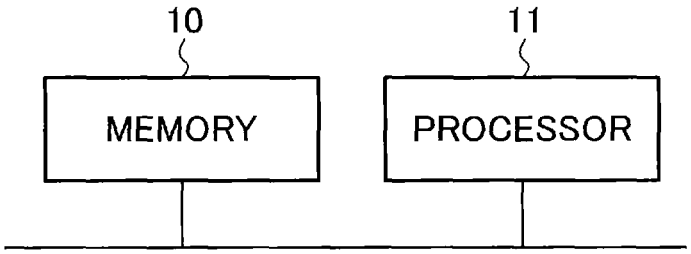
FIGS. 2A and 2B are block diagrams illustrating hardware configuration examples.

As illustrated in FIG. 2A, for example, a part or whole of the terminal control unit 112 described above may be implemented by a memory 10 and a processor 11, such as a central processing unit (CPU), that executes a program stored in the memory 10. Such a program may be provided through a network or in the form of being recorded on a recording medium. That is, such a program may be provided as, for example, a program product.

Figure 2B:
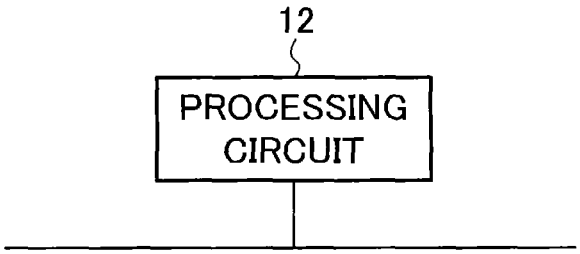

As illustrated in FIG. 2B, for example, a part or whole of the terminal control unit 112 may be implemented by a processing circuit 12 such as a single circuit, a composite circuit, a programmed processor, a parallel-programmed processor, an application specific integrated circuit (ASIC), or a field programmable gate array (FPGA).

With reference to FIG. 1 again, the air conditioner 130 includes an air conditioning communication unit 131, a wind velocity calculation unit 132, a storage unit 133, an air conditioning control determination unit 134, an air conditioning control unit 135, and an air conditioning unit 136.

The air conditioning communication unit 131 communicates with the network 101. For example, the air conditioning communication unit 131 receives an air pressure value from the portable terminal 110. The received air pressure value is given to the wind velocity calculation unit 132. The air conditioning communication unit 131 can be implemented by, for example, an NIC.

The wind velocity calculation unit 132 causes the storage unit 133 to store an air pressure value given by the air conditioning communication unit 131.

The wind velocity calculation unit 132 calculates a wind velocity of wind received by the portable terminal 110. For example, the wind velocity calculation unit 132 calculates a wind velocity of wind received by the portable terminal 110, based on a variation in a plurality of air pressure values stored in the storage unit 133 and set values of a current wind direction and a current airflow volume of the air conditioner 130 input from the air conditioning control unit 135. Specifically, the wind velocity calculation unit 132 specifies the variation in the air pressure values by using a target difference that is a difference between a first air pressure value measured by the air pressure measurement unit 111 with the current wind direction and the current airflow volume of the air conditioner 130, and a smallest value in a plurality of second air pressure values measured a plurality of times by the air pressure measurement unit 111 while the wind directions of the air conditioning unit 136 are changed in a horizontal direction. Then, the wind velocity calculation unit 132 calculates a wind velocity by using a square root of a value obtained by dividing a double of the variation by an air density. In a case where the portable terminal 110 receives wind from the air conditioning unit 136, the target difference is corrected in accordance with the orientation of the air pressure measurement unit 111 of the portable terminal 110.

The wind velocity calculation unit 132 specifies a presence direction that is a direction in which the portable terminal 110 is present.

The calculated wind velocity and the specified presence direction in those ways are given to the air conditioning control determination unit 134.

The storage unit 133 stores information necessary for processing in the air conditioner 130. For example, the storage unit 133 stores an air pressure value given by the wind velocity calculation unit 132. The storage unit 133 can be implemented by a volatile memory or a nonvolatile memory.

In accordance with the set values of the current wind direction and the current airflow volume, and in accordance with the wind velocity and the presence direction given by the wind velocity calculation unit 132, the air conditioning control determination unit 134 determines details of control on the wind direction and the airflow volume of the air conditioner 130, and gives the details of control on the wind direction and the airflow volume to the air conditioning control unit 135.

In accordance with the details of control on the wind direction and the airflow volume given by the air conditioning control determination unit 134, the air conditioning control unit 135 sets a wind direction and an airflow volume to the air conditioning unit 136 such that the air conditioner 130 can output wind, and the air conditioning control unit 135 gives the set values to the wind velocity calculation unit 132 as the set values of the current wind direction and the current airflow volume.

The air conditioning unit 136 is a unit that performs conditioning of air. For example, the air conditioning unit 136 uses a refrigeration cycle to cool or heat air, and emits the cooled or heated air in the set wind direction at the set airflow volume. The air conditioning unit 136 is capable of changing the wind directions and the airflow volumes.

As illustrated in FIG. 2A, for example, a part or whole of the wind velocity calculation unit 132, the air conditioning control determination unit 134, and the air conditioning control unit 135 described above can be implemented by the memory 10 and the processor 11, such as a CPU, that executes a program stored in the memory 10. Such a program may be provided through a network or in the form of being recorded on a recording medium. That is, such a program may be provided as, for example, a program product.

As illustrated in FIG. 2B, for example, a part or whole of the wind velocity calculation unit 132, the air conditioning control determination unit 134, and the air conditioning control unit 135 may be implemented by a single circuit, a composite circuit, a programmed processor, a parallel-programmed processor, or a processing circuit 12 such as an ASIC or an FPGA.

An operation in the air conditioning control system 100 will now be described.

First, an outline of the operation in the air conditioning control system 100 will be described.

Wind emitted from the air conditioner 130 changes the air pressure in a room. The change in the air pressure varies depending on locations in the room even in the same conditions of the wind direction, wind velocity, and temperature of wind emitted from the air conditioner 130.

The wind emitted from the air conditioner 130 is affected by, for example, the distance from the air conditioner 130, furniture placed between the air conditioner 130 and a measured place, an object around the measured place, a movement of a person, wind emitted from a device other than the air conditioner 130, or wind entering through an opening of a window, a door, or the like.

In this embodiment, a place where wind is detected is a place where the portable terminal 110 is placed, and wind received by the portable terminal 110 is calculated from an air pressure value measured by the air pressure measurement unit 111 of the portable terminal 110.

The air pressure value measured by the air pressure measurement unit 111 is given to the terminal communication unit 113 of the portable terminal 110. The measured air pressure value is transmitted from the terminal communication unit 113 to the air conditioner 130, and received by the air conditioning communication unit 131. The received air pressure value is given to the wind velocity calculation unit 132, and the wind velocity calculation unit 132 calculates a wind velocity of wind received by the portable terminal 110, based on the air pressure value given by the air conditioning communication unit 131 and the set values of the current wind direction and the current airflow volume given by the air conditioning control unit 135.

Figure 3:
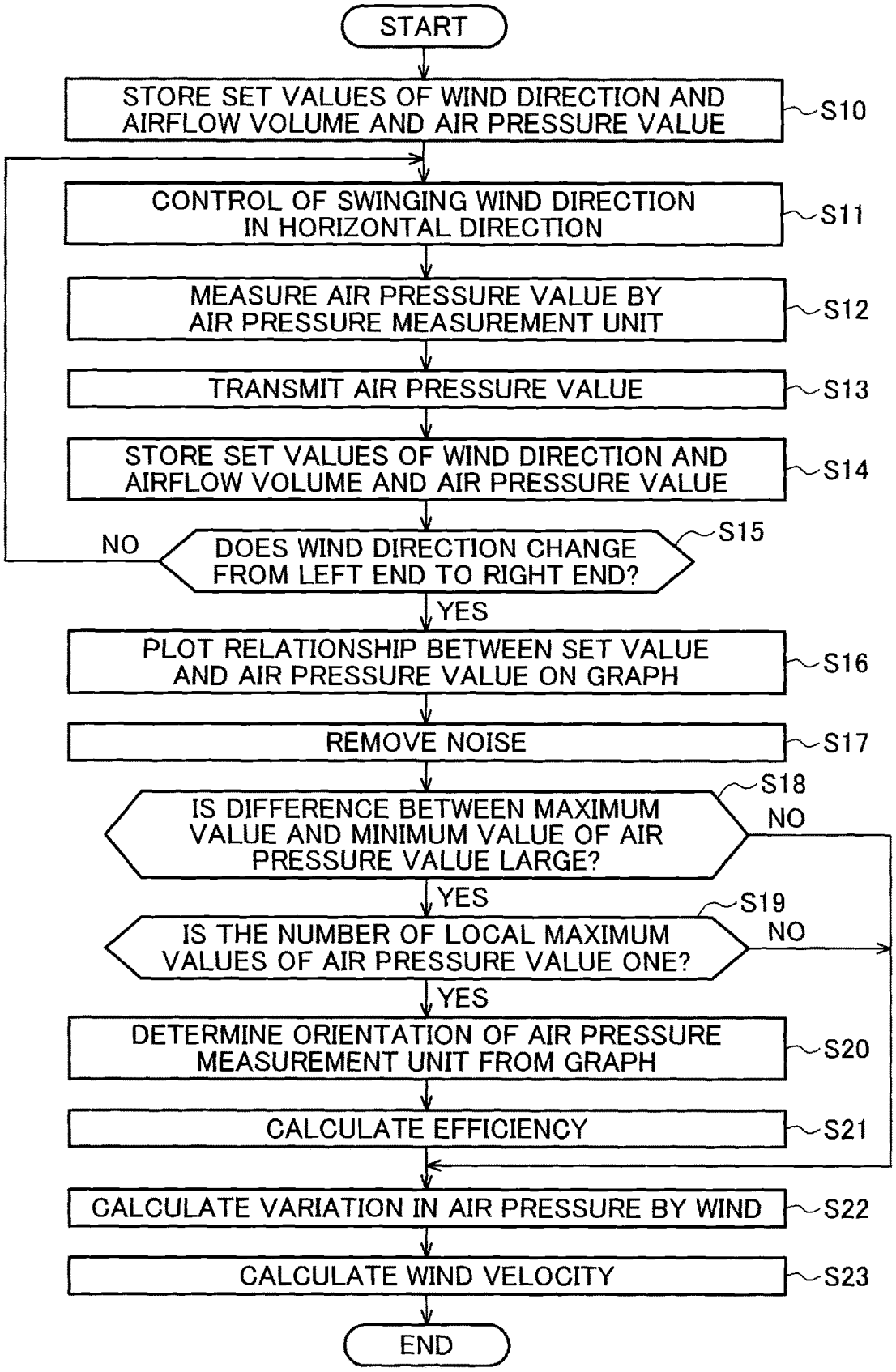
FIG. 3 is a flowchart depicting a process of calculating a wind velocity.

FIG. 3 is a flowchart depicting a process of calculating a wind velocity in the wind velocity calculation unit 132.

First, the wind velocity calculation unit 132 causes the storage unit 133 to store set values of the latest wind direction and the latest airflow volume given by the air conditioning control unit 135 and the latest air pressure value given by the portable terminal 110 (S10).

Then, the wind velocity calculation unit 132 instructs the air conditioning control determination unit 134 to perform control of swinging the wind direction of the air conditioning unit 136 in a horizontal direction (S11). To calculate a wind velocity, the air conditioning control determination unit 134 that has received such an instruction determines a wind direction and airflow volume control instruction for controlling a wind direction and an airflow volume to be output from the air conditioning unit 136 in accordance with the instruction of the wind velocity calculation unit 132, and gives the instruction to the air conditioning control unit 135. The air conditioning control unit 135 controls the wind direction and the airflow volume in accordance with the wind direction and airflow volume control instruction given by the air conditioning control determination unit 134. According to such control, the air conditioning unit 136 changes the wind direction to the left or the right by a predetermined degree. The direction to which the wind direction is changed may be previously determined, or may be determined to a direction with a larger change degree from the current wind direction position. After control on the air conditioning unit 136, the air conditioning control unit 135 gives to the wind velocity calculation unit 132 set values of the wind direction and the airflow volume after change.

Thereafter, the air pressure measurement unit 111 of the portable terminal 110 measures an air pressure value (S12).

The terminal control unit 112 receives the measured air pressure value from the air pressure measurement unit 111, and transmits the air pressure value from the terminal communication unit 113 to the air conditioner 130 (S13).

Subsequently, the wind velocity calculation unit 132 causes the storage unit 133 to store the set values of the current wind direction and the current airflow volume given by the air conditioning control unit 135 in step S11 and the air pressure value given by the portable terminal 110 in step S13 (S14).

Then, the wind velocity calculation unit 132 determines whether or not the set value of the wind direction stored in the storage unit 133 changes from the right end to the left end that can be set in the horizontal direction by the air conditioning unit 136 (S15). If the set value of the wind direction has changes from the right end to the left end (Yes in S15), the process proceeds to step S16, whereas if the set value of the wind direction has not changed yet (No in S15), the process returns to step S11.

In the processes of steps S11 to S14, the air conditioning control unit 135 does not need to change the wind direction from the right end sequentially. For example, it is sufficient that the wind direction is changed to one of the right or the left from a position at which a wind direction at the start of the flow shown in FIG. 3 is set, and when the wind direction reaches the end, the wind direction is changed to the other one of the right or the left, and this operation is repeated. Accordingly, it is sufficient that the storage unit 133 stores set values of the wind direction and the airflow volume in cases where the wind direction are set at the right end, where these set values are set at the left end, and where the set values are set at intermediate positions between the right end and the left end, and also stores air pressure values in these set values. A plurality of set values are necessary in the case of the intermediate positions. For example, the air pressure values are measured for 10 or more intermediate wind direction positions between the right end and the left end.

In step S16, the wind velocity calculation unit 132 creates a graph showing fluctuations of the air pressure values corresponding to the set values of the wind directions, from the set values of the wind directions and the air pressure values stored in the storage unit 133 in step S14.

Figure 4:
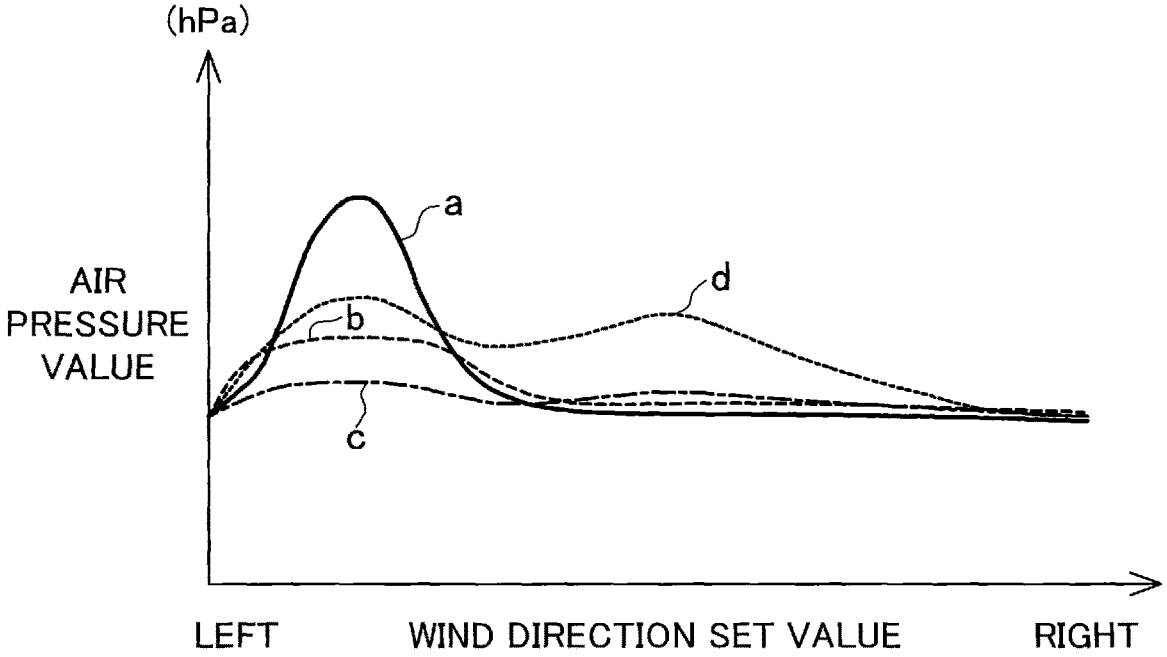
FIG. 4 is a schematic view illustrating an example of a graph showing fluctuations of an air pressure values corresponding to set values of wind directions.

FIG. 4 shows a schematic diagram showing an example of a graph showing fluctuations of the air pressure values corresponding to set values of the wind directions and the graph is created in step S16.

In this graph, the abscissa represents the set values of the wind directions, and the ordinate represents the air pressure values (hPa).

The wind velocity calculation unit 132 plots the set values of the wind directions stored in the storage unit 133 and air pressure values at these set values on the graph of FIG. 4, and the plotted points are connected to one another.

Thereafter, the wind velocity calculation unit 132 performs the process of removing noise that is minute changes in the air pressure values (S17). This process is performed in order to avoid influence of the minute changes in the air pressure values in subsequent processes. Specifically, the wind velocity calculation unit 132 filters the air pressure values to smooth the values. As a filter for smoothing, a filter such as a mean filter or a Gaussian filter is used.

Curves a through d shown in FIG. 4 represent fluctuations of the air pressure values after removal of noise in step S16. Curve a and curve b represent fluctuations of the air pressure values in the case of changing only the orientation of the portable terminal 110 without changing the location of the portable terminal 110. For example, if the portable terminal 110 is a smartphone, curve a and curve b represent a difference between a case where a display side faces the ceiling and the side opposite to the display side faces the ceiling.

Curve c and curve d indicate fluctuations of the air pressure value in a case where the portable terminal 110 is placed at a location where wind from the air conditioner 130 does not hit the portable terminal 110.

The airflow volume of wind from the air conditioner 130 is not changed. Details of the difference among the curves will be described in the following steps.

With reference to FIG. 3 again, the wind velocity calculation unit 132 then specifies a maximum value and a minimum value in a curve representing fluctuations of the air pressure values, and calculates the difference between the maximum value and the minimum value. Thereafter, the wind velocity calculation unit 132 determines whether the difference is larger than a predetermined threshold or not (S18). If the difference is larger than the predetermined threshold (Yes in S18), it is determined that wind directly hits the portable terminal 110, and the process proceeds to step S19. If the difference is less than or equal to the predetermined threshold (No in S18), it is determined that wind does not directly hit the portable terminal 110, and the process proceeds to step S22. The threshold here is, for example, 1.36 hPa. This value means that at a room temperature of 20° C., there is no wind at 1.5 m/s or more, which is a maximum wind velocity at which a person does not feel wind on their face. The air density varies depending on the room temperature, and is 1.293 at 0° C., 1.247 at 10° C., and 1.165 at 30° C. As will be described later, the wind velocity depends on the variation in the air pressure values and the air density.

Subsequently, the wind velocity calculation unit 132 calculates the number of local maximum values in a curve representing fluctuations of the air pressure values. The wind velocity calculation unit 132 determines whether or not the local maximum value is equal to the maximum value and the number of local maximum values is one (S19). If the local maximum value is equal to the maximum value and the number of local maximum values is one (Yes in S19), it is determined that the portable terminal 110 receives wind from the air conditioner 130, and the process proceeds to step S20. If the local maximum value is different from the maximum value, or if the number of local maximum values is two or more (No in S19), it is determined that the portable terminal 110 does not receive wind from the air conditioner 130, and the process proceeds to step S22.

The air pressure value measured by the air pressure measurement unit 111 of the portable terminal 110 is at maximum when the portable terminal 110 is located in a direction in which wind is emitted from the air conditioner 130. Thus, it can be said that the portable terminal 110 is located in a direction of a set value of the wind direction at which the air pressure value measured by the air pressure measurement unit 111 is at maximum. In FIG. 4, curve a and curve b correspond to such a case.

A difference between curve a and curve b in FIG. 4 will now be described.

Figure 5A:
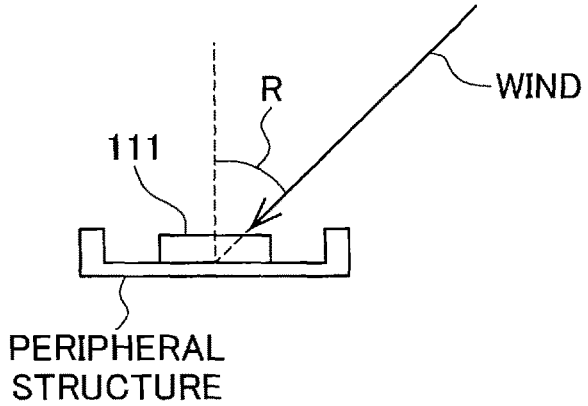
FIGS. 5A and 5B are schematic drawings for explaining a relationship between an angle at which wind hits an air pressure measurement unit and an air pressure value measured by the air pressure measurement unit.

As illustrated in FIG. 5A, in detecting an air pressure value by the air pressure measurement unit 111, the air pressure value varies depending on the angle at which wind hits the air pressure measurement unit 111.

As illustrated in FIG. 5A, an angle R at which wind hits the air pressure measurement unit 111 is set.

Figure 5B:
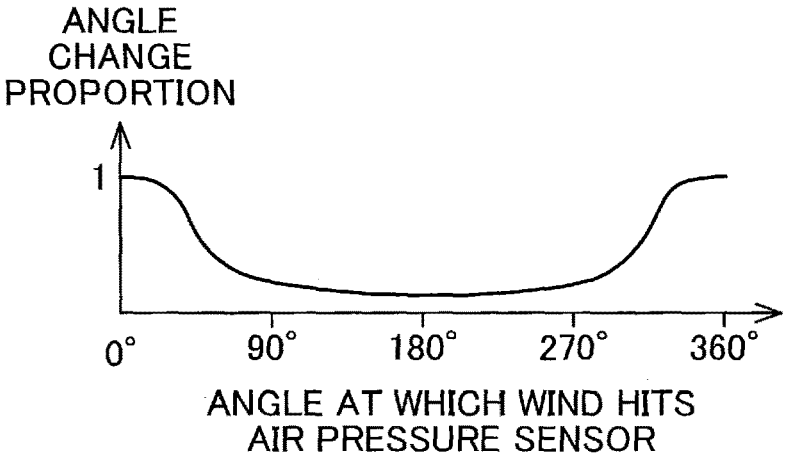

FIG. 5B shows angle change proportions that are proportions of changes in the air pressure values at the angle R. The angle change proportion is 1 at an angle of 0°. In other words, an angle change proportion can be calculated by dividing the air pressure value at each angle by the air pressure value at 0°, that is, by the maximum value of the air pressure value. The wind velocity calculation unit 132 corrects the difference between air pressure values that have varied depending on the directions of the air pressure measurement unit 111 by using the angle change proportions, and estimates wind received by the portable terminal 110.

With a change shown in FIG. 5B, it is expected that wind hits the air pressure measurement unit 111 from a direction close to a direction perpendicular to the air pressure measurement unit 111 in a case of curve a shown in FIG. 4, and it is expected that wind hits the air pressure measurement unit 111 from the back of the air pressure measurement unit 111 in a case of curve b.

In view of this, in step S21 of FIG. 3, the wind velocity calculation unit 132 specifies an angle at which wind hits the air pressure measurement unit 111. For example, the storage unit 133 previously stores angle information indicating an angle corresponding to a difference between the maximum value and the minimum value of the air pressure value. The wind velocity calculation unit 132 specifies an angle corresponding to the difference calculated in step S18 by referring to the angle information.

The wind velocity calculation unit 132 specifies an angle change proportion (hereinafter referred to as an efficiency) corresponding to the angle specified in step S21 (S21). For example, the storage unit 133 previously stores efficiency information indicating a relationship between an angle and an efficiency as shown in FIG. 5B. The wind velocity calculation unit 132 specifies an efficiency corresponding to the angle specified in step S21 by referring to the efficiency information.

The wind velocity calculation unit 132 may acquire information indicating such a relationship from the network 101 through the air conditioning communication unit 131.

Alternatively, the wind velocity calculation unit 132 may instruct a user to rotate the portable terminal 110 and calculate such a relationship from a rotation angle and an air pressure value at the rotation angle.

In step S18, if the difference between the maximum value and the minimum value of the air pressure value is less than or equal to the predetermined threshold (No in S18), the wind velocity calculation unit 132 determines that no wind hits the portable terminal 110. Curve c in FIG. 4 corresponds to this case.

In step S19, if the number of local maximum values of the air pressure value is two or more (No in S19), the wind velocity calculation unit 132 determines that wind hits the portable terminal 110 from a plurality of directions. Curve d in FIG. 4 corresponds to this case.

In that case (No in step S18 or No in step S19), the process proceeds to step S22.

In step S22, the wind velocity calculation unit 132 calculates the variation in the air pressure values caused by wind. A method for calculating the variation in the air pressure values varies depending on a preceding step. If the preceding step is step S21, the wind velocity calculation unit 132 uses, as the variation in the air pressure values, a value obtained by dividing, by the efficiency specified in step S21, a value obtained by subtracting the minimum value of the graph created in step S16 from the air pressure value stored in step S10.

If the preceding step is step S18 or step S19, the wind velocity calculation unit 132 uses, as the variation in the air pressure values, a value obtained by subtracting the minimum value of the graph created in step S16 from the air pressure value stored in step S10.

The value obtained by subtracting the minimum value of the graph created in step S16 from the air pressure value stored in step S10 is also referred to as a target difference.

Subsequently, the wind velocity calculation unit 132 uses the variation in the air pressure values, which is calculated in step S22, to calculate the wind velocity by Equation (1) below.

In Equation (1), V is a wind velocity (m/s), d is an air density (kg/m$^3$), and Pv is the variation in the air pressure values (hPa). The air density varies depending on the temperature, and in this embodiment, "1.205," which is the air density at a room temperature of 20° C. is used.

[Equation 1]

$$V = \sqrt{\frac{2Pv}{d}} \tag{1}$$

Equation (1) is an equation derived from the Bernoulli's theorem.

As described above, the wind velocity calculation unit 132 is capable of calculating a wind velocity by using the Bernoulli's theorem from the air pressure values measured by the portable terminal 110.

The wind velocity calculated in the above-mentioned way is given to the air conditioning control determination unit 134.

From the determination results in step S18 and S19, the wind velocity calculation unit 132 specifies a presence direction that is a direction in which the portable terminal 110 is present, and gives the specified presence direction to the air conditioning control determination unit 134. For example, if the determination results in step S18 and S19 are Yes, the wind velocity calculation unit 132 determines, in step S16, that the portable terminal 110 is present in the direction of the set value of the wind direction corresponding to the maximum value of the air pressure value.

On the other hand, if the determination result of steps S18 or S19 is No, the wind velocity calculation unit 132 determines that the portable terminal 110 is not present in a range in which the wind direction of the air conditioner 130 can be set. In other words, the wind velocity calculation unit 132 determines that the portable terminal 110 is present in a range in which the wind direction of the air conditioner 130 cannot be set.

The wind velocity calculation unit 132 gives the determination results as described above to the air conditioning control determination unit 134 as the presence direction of the portable terminal 110.

The air conditioning control determination unit 134 determines an air conditioning method by using the set values of the current wind direction and the current airflow volume, the wind velocity calculated by the wind velocity calculation unit 132, and the presence direction of the portable terminal 110. At this time, the air conditioning control determination unit 134 hypothesizes that the portable terminal 110 is placed at the user side, and performs control for preventing wind from directly hitting the user, control for setting the wind velocity such that the user feels comfortable, or control the degree of hitting of wind depending on the period and the point of time, for example. It is assumed that the air conditioning method is previously determined in accordance with a combination of the set values of the current wind direction and the current airflow volume, the wind velocity, and the presence direction.

The air velocity in consideration of comfort is preferably 0.3 m/s or less at a set temperature less than 27° C. in cooling in a summer season, and is preferably 0.5 m/s to 1.0 m/s at a set temperature of 27° C. or more in heating in a winter season or in cooling in a summer season. With respect to the wind velocity and user's feeling, a wind velocity with which the user feels comfortable is previously determined with reference to, for example, a Beaufort wind scale chart or the like.

The portable terminal 110 is assumed to be a smartphone or a cellular phone, but is not limited to these examples as long as the portable terminal 110 includes an air pressure sensor and a communication device that transmits an air pressure value measured by the air pressure sensor. For example, the portable terminal 110 may be an alarm clock including the air pressure sensor and the communication device or an alarm clock retrofitted with a module including the air pressure sensor and the communication device.

In the first embodiment, a configuration in which the air conditioning control unit 135 gives the wind direction of wind to be emitted from the air conditioner 130 and the set value of the airflow volume to the wind velocity calculation unit 132 has been described. Alternatively, the air conditioning control determination unit 134 may give the wind direction and the set value of the airflow volume to the wind velocity calculation unit 132. In this case, processing is performed on the assumption that a control instruction of the wind direction and the airflow volume determined by the air conditioning control determination unit 134 is executed by the air conditioning control unit 135.

In the first embodiment, the wind velocity calculation unit 132 calculates a wind velocity by using the air pressure values measured by the air pressure measurement unit 111. However, the first embodiment is not limited to this example.

For example, the wind velocity calculation unit 132 may calculate a wind velocity by using sound detected by an unillustrated microphone incorporated in the portable terminal 110. Fluctuations of air caused by wind are detected as noise of the microphone serving as a sound collecting unit. Since noise caused by wind is very low frequency sound, the terminal control unit 112 takes only a low frequency range through a low-pass filter from noise (gain) detected by the microphone so that an output value indicating a noise amount can be given to the wind velocity calculation unit 132.

Instead of using the microphone, sound detected by an unillustrated speaker incorporated in the portable terminal 110 may be used to calculate a wind velocity. In the case of using the speaker, vibrations of a vibration plate of the speaker caused by wind are detected, and a circuit for amplifying the detected vibrations and transmitting the amplified vibrations as a signal to the wind velocity calculation unit 132 is added. In this manner, it is possible to detect the variation in noise to a degree with which a wind velocity can be obtained.

Instead of the variation in a plurality of air pressure values, the wind velocity calculation unit 132 may use the variation in a plurality of output values in a low frequency range of noise detected by the microphone to specify a wind velocity. For example, the storage unit 133 previously stores wind velocity information for associating the variation with the wind velocity so that the wind velocity calculation unit 132 can specify a wind velocity. In this case, the wind velocity calculation unit 132 functions as a wind velocity specifying unit.

In this case, in step S12 and S13 of the flowchart shown in FIG. 3, output values in a low frequency range of noise detected by the microphone are measured and stored, instead of air pressure values.

The output values in a low frequency range of noise detected by the microphone are measured and stored at the same time as the air pressure values so that the wind velocity calculation unit 132 can complement the wind velocity measured only by the air pressure measurement unit 111 and also increase a wind velocity estimation accuracy. In such a case, for example, by using a mean value of a wind velocity calculated from an air pressure value and a wind velocity calculated from noise, the wind velocity estimation accuracy is increased.

As described above, in the air conditioning control system 100 according to the first embodiment, a wind velocity at a place where the portable terminal 110 is placed is specified and used for the feedback to control on the air conditioner 130. Thus, a preferable environment can be made at the place where the portable terminal 110 is placed. In view of this, the user places the portable terminal 110 near, for example, a target such as a person, a pet, or food to which the user wants to provide comfortable space, thereby providing the target with comfortable air conditioning when demanded.

In the air conditioning control system 100 according to the first embodiment, the portable terminal 110 can measure an air pressure value with the air pressure measurement unit 111 and transmit the air pressure value to the air conditioner 130. Thus, the portable terminal 110 having no function related to air conditioning can be used.

In the air conditioning control system 100 according to the first embodiment, by distinguishing wind received by the portable terminal 110 and wind hitting the air pressure measurement unit 111, a change in the air pressure value depending on orientation of placement of the air pressure measurement unit 111 can be corrected.

In addition, in the air conditioning control system 100 according to the first embodiment, the direction in which the portable terminal 110 is present can be specified from an air pressure value measured by the air pressure measurement unit 111 provided in the portable terminal 110. Thus, a comfortable space can be made in the direction in which the portable terminal 110 is present.

In the air conditioning control system 100 according to the first embodiment, by adding an air pressure sensor and a communication device, a portable target can be used as the portable terminal 110. Thus, the portable terminal 110 can be implemented not only by a smartphone or a cellular phone but also by a portable target such as an alarm clock. For example, an alarm clock is often placed near a user while the user is asleep and cannot control the air conditioner 130 with a remote controller. Thus, the alarm clock can monitor an environment instead of the user.

Second Embodiment

Figure 6:
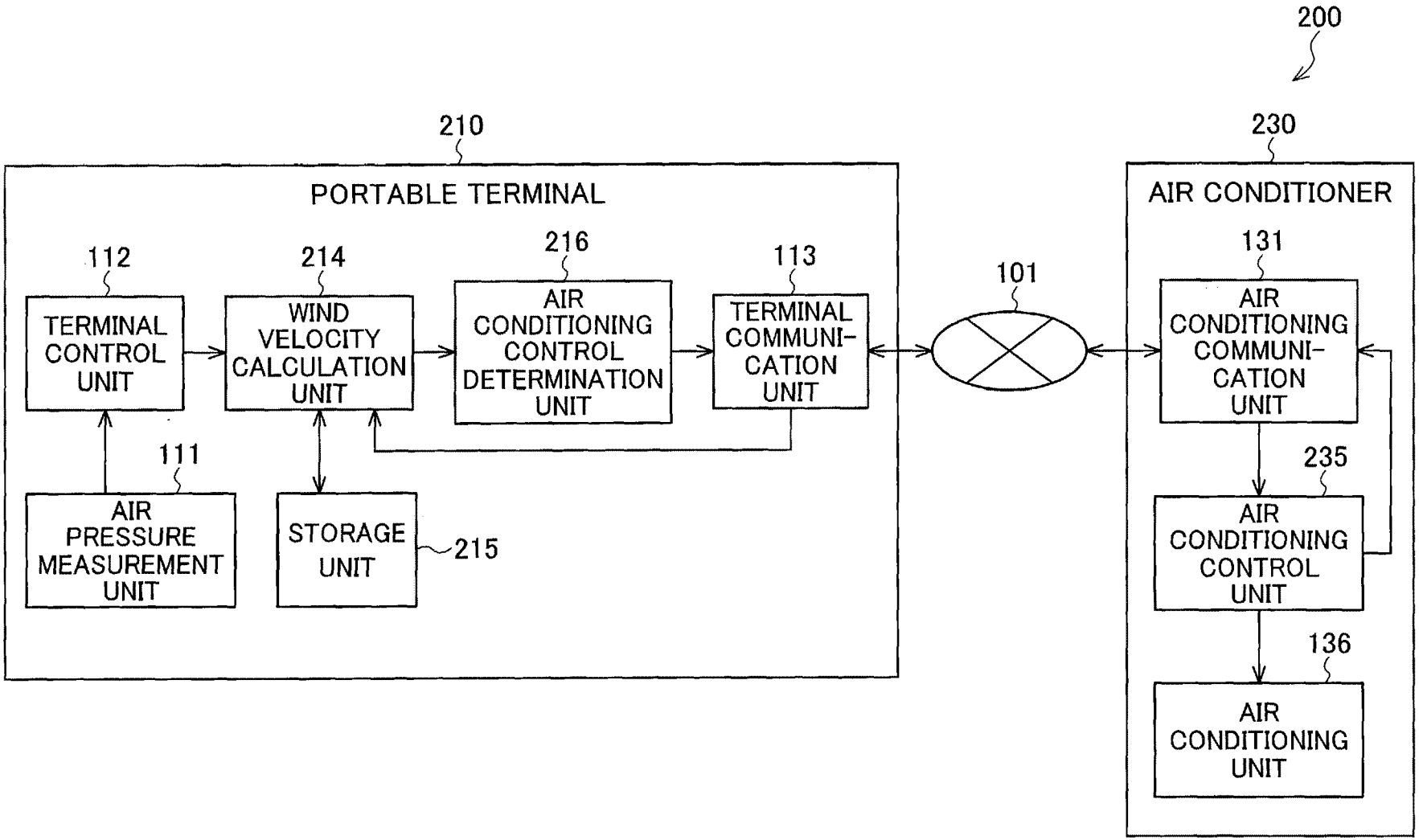
FIG. 6 is a block diagram schematically illustrating a configuration of an air conditioning control system according to a second embodiment.

FIG. 6 is a block diagram schematically illustrating a configuration of an air conditioning control system 200 according to a second embodiment.

The air conditioning control system 200 includes a portable terminal 210 and an air conditioner 230.

The portable terminal 210 and the air conditioner 230 are connected to a network 101.

The portable terminal 210 includes an air pressure measurement unit 111, a terminal control unit 112, a terminal communication unit 113, a wind velocity calculation unit 214, a storage unit 215, and an air conditioning control determination unit 216.

The air pressure measurement unit 111, the terminal control unit 112, and the terminal communication unit 113 in the second embodiment are similar to those in the first embodiment. The terminal control unit 112 in the second embodiment gives an air pressure value given by the air pressure measurement unit 111, to the wind velocity calculation unit 214. The terminal communication unit 113 in the second embodiment transmits details of control on a wind direction and an airflow volume given by the air conditioning control determination unit 216 to the air conditioner 230, receives set values of the current wind direction and the current airflow volume from the air conditioner 230, and gives the set values to the wind velocity calculation unit 214.

The wind velocity calculation unit 214 causes the storage unit 215 to store an air pressure value given by the terminal control unit 112. Based on the variation in a plurality of air pressure values stored in the storage unit 215 and the set values of the current wind direction and the current airflow volume of the air conditioner 230 given by the terminal communication unit 113, the wind velocity calculation unit 214 calculates a wind velocity of wind received by the portable terminal 210 and specifies a presence direction of the portable terminal 210. The calculated wind velocity and the specified presence direction are given to the air conditioning control determination unit 216.

The storage unit 215 stores information necessary for processing in the portable terminal 210. For example, the storage unit 215 stores an air pressure value given by the wind velocity calculation unit 214. The storage unit 215 can be implemented by a volatile memory or a nonvolatile memory.

The air conditioning control determination unit 216 determines details of control on the wind direction and the airflow volume of the air conditioner 230 in accordance with the set values of the current wind direction and the current airflow volume and the wind velocity and the presence direction given by the wind velocity calculation unit 214, and causes the terminal communication unit 113 to transmit the details of control on the wind direction and the airflow volume to the air conditioner 230. For example, as the air conditioning control determination unit 216, an application for a remote controller of a smartphone may be used.

As illustrated in FIG. 2A, for example, a part or whole of the terminal control unit 112, the wind velocity calculation unit 214, and the air conditioning control determination unit 216 may be implemented by the memory 10 and the processor 11.

A part of the terminal control unit 112, the wind velocity calculation unit 214, and the air conditioning control determination unit 216 may also be implemented by the processing circuit 12, as illustrated in FIG. 2B, for example.

The air conditioner 230 includes an air conditioning communication unit 131, an air conditioning control unit 235, and an air conditioning unit 136.

The air conditioning communication unit 131 and the air conditioning unit 136 in the second embodiment are similar to those in the first embodiment. The air conditioning communication unit 131 receives details of control on the wind direction and the airflow volume from the portable terminal 210, and gives the details of control on the wind direction and the airflow volume to the air conditioning control unit 235. The air conditioning communication unit 131 receives the set values of the current wind direction and the current airflow volume from the air conditioning control unit 235, and transmits the received set values of the current wind direction and the current airflow volume to the portable terminal 210.

The air conditioning control unit 235 sets a wind direction and an airflow volume to the air conditioning unit 136 such that the air conditioner 230 outputs wind in accordance with the details of control on the wind direction and the airflow volume given by the air conditioning communication unit 131, and the air conditioning control unit 235 gives the set values to the air conditioning communication unit 131 as the set values of the current wind direction and the current airflow volume.

As illustrated in FIG. 2A, for example, a part or whole of the air conditioning control unit 235 described above may be implemented by the memory 10 and the processor 11.

A part of the air conditioning control unit 235 may also be implemented by the processing circuit 12, as illustrated in FIG. 2B, for example.

As described above, in the second embodiment, the air conditioner 230 can be controlled by the portable terminal 210, and thus, the air conditioner 230 that has already been installed can be used.

Third Embodiment

Figure 7:
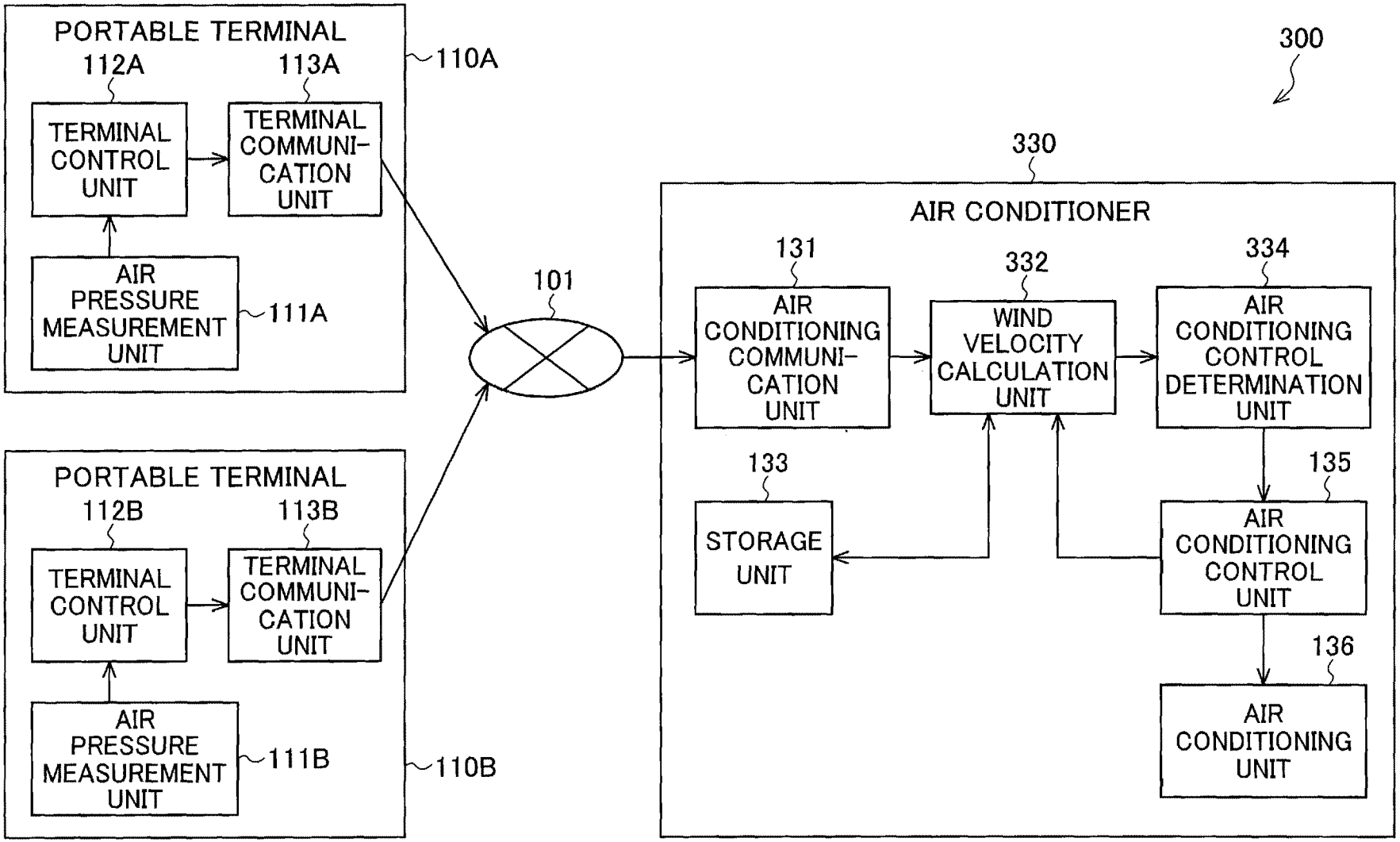
FIG. 7 is a block diagram schematically illustrating a configuration of an air conditioning control system according to a third embodiment.

FIG. 7 is a block diagram schematically illustrating a configuration of an air conditioning control system 300 according to a third embodiment.

The air conditioning control system 300 includes a first portable terminal 110A, a second portable terminal 110B, and an air conditioner 330.

The first portable terminal 110A, the second portable terminal 110B, and the air conditioner 330 are connected to a network 101.

The first portable terminal 110A includes an air pressure measurement unit 111A, a terminal control unit 112A, and a terminal communication unit 113A.

The air pressure measurement unit 111A, the terminal control unit 112A, and the terminal communication unit 113A in the first portable terminal 110A are similar to the air pressure measurement unit 111, the terminal control unit 112, and the terminal communication unit 113 of the portable terminal 110 in the first embodiment.

The second portable terminal 110B includes an air pressure measurement unit 111B, a terminal control unit 112B, and a terminal communication unit 113B.

The air pressure measurement unit 111B, the terminal control unit 112B, and the terminal communication unit 113B in the second portable terminal 110B are similar to the air pressure measurement unit 111, the terminal control unit 112, and the terminal communication unit 113 of the portable terminal 110 in the first embodiment.

The air conditioner 330 includes an air conditioning communication unit 131, a wind velocity calculation unit 332, a storage unit 133, an air conditioning control determination unit 334, an air conditioning control unit 135, and an air conditioning unit 136.

The air conditioning communication unit 131, the storage unit 133, the air conditioning control unit 135, and the air conditioning unit 136 in the third embodiment are similar to those in the first embodiment.

The wind velocity calculation unit 332 causes the storage unit 133 to store an air pressure value measured by the first portable terminal 110A and an air pressure value measured by the second portable terminal 110B, which are given by the air conditioning communication unit 131. Based on the variation in the air pressure values of the first portable terminal 110A and set values of the current wind direction and the current airflow volume of the air conditioner 130 input from the air conditioning control unit 135, which are stored in the storage unit 133, the wind velocity calculation unit 332 calculates a wind velocity of wind received by the first portable terminal 110A and specifies a presence direction in which the first portable terminal 110A is present. Based on the variation in the air pressure values of the second portable terminal 110B and the set values of the current wind direction and the current airflow volume of the air conditioner 130 input from the air conditioning control unit 135, which are stored in the storage unit 133, the wind velocity calculation unit 332 calculates a wind velocity of wind received by the second portable terminal 110B and specifies a presence direction in which the second portable terminal 110B is present. The wind velocity calculated by the first portable terminal 110A, the presence direction specified by the first portable terminal 110A, the wind velocity calculated by the second portable terminal 110B, and the presence direction specified by the second portable terminal 110B are given to the air conditioning control determination unit 334.

In accordance with the set values of the current wind direction and the current airflow volume, the wind velocity and the presence direction calculated and specified by the first portable terminal 110A and given by the wind velocity calculation unit 332, and the wind velocity and the presence direction calculated and specified by the second portable terminal 110B and given by the wind velocity calculation unit 332, the air conditioning control determination unit 334 determines details of control on the wind direction and the airflow volume of the air conditioner 330 and gives the details of control on the wind direction and the airflow volume to the air conditioning control unit 135.

In this embodiment, it is sufficient that the air conditioning control determination unit 334 can perform air conditioning control comfortable for both the first portable terminal 110A and the second portable terminal 110B, but in a case where different controls are needed for the same place, one of these controls is assigned with priority and is performed according to the priority.

Although two portable terminals 110 are used in the third embodiment, the number of portable terminals 110 is not limited to two, and three or more portable terminals 110 may be used.

In the third embodiment, even the plurality of portable terminals 110 are provided, comfortable air conditioning control can be performed to a specific place.

Fourth Embodiment

Figure 8:
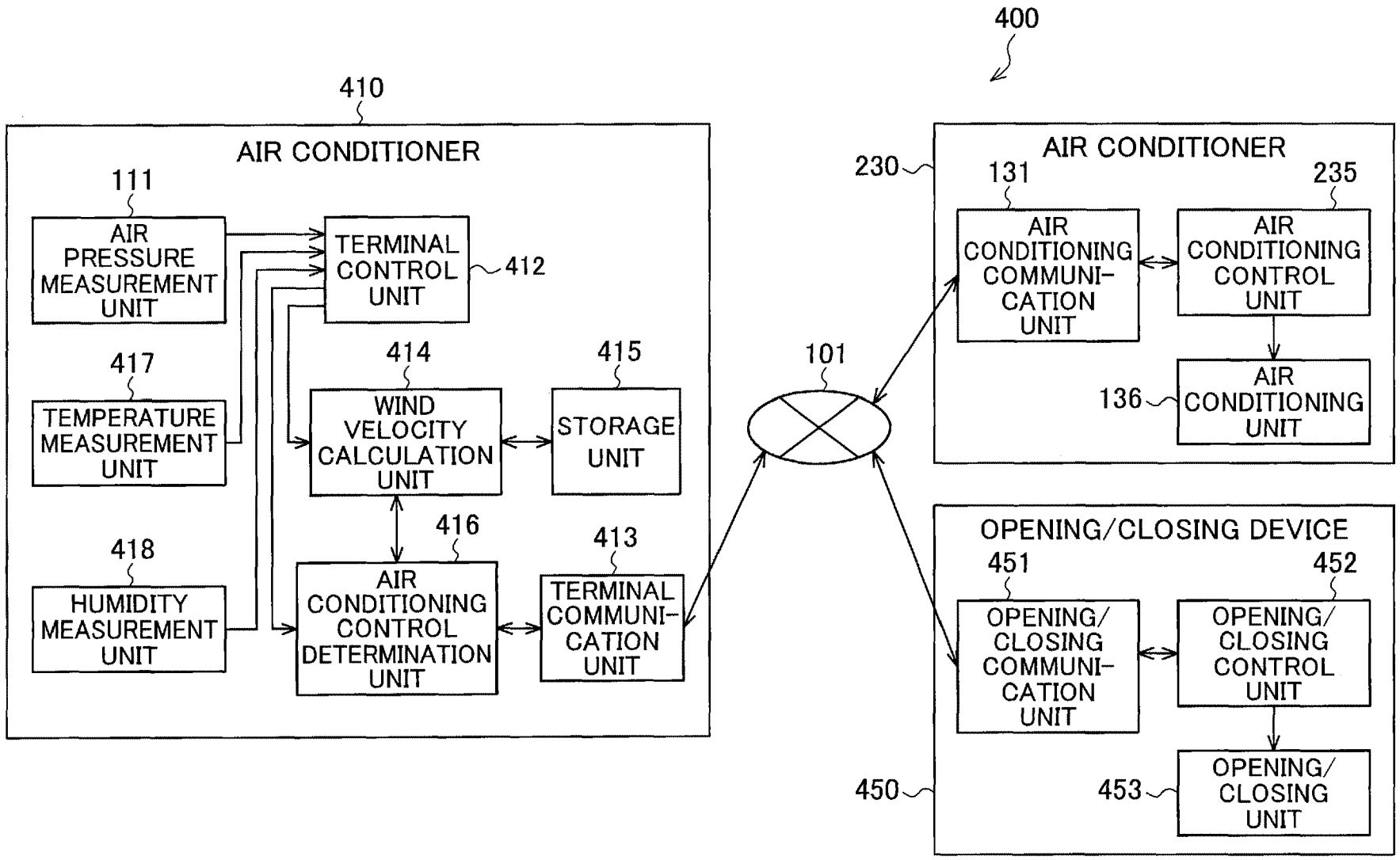
FIG. 8 is a block diagram schematically illustrating a configuration of an air conditioning control system according to a fourth embodiment.

FIG. 8 is a block diagram schematically illustrating a configuration of an air conditioning control system 400 according to a fourth embodiment.

The air conditioning control system 400 includes a portable terminal 410, an air conditioner 230, and an opening/closing device 450.

The portable terminal 410, the air conditioner 230, and the opening/closing device 450 are connected to a network 101, The conditioner 230 in the fourth embodiment is similar to that in the second embodiment.

The portable terminal 410 includes an air pressure measurement unit 111, a terminal control unit 412, a terminal communication unit 413, a wind velocity calculation unit 414, a storage unit 415, an air conditioning control determination unit 416, a temperature measurement unit 417, and a humidity measurement unit 418.

The air pressure measurement unit 111 in the fourth embodiment is similar to that in the first embodiment.

The temperature measurement unit 417 is a temperature sensor that measures a temperature and gives the measured temperature to the terminal control unit 412.

The humidity measurement unit 418 is a humidity sensor measures a humidity and gives the measured humidity to the terminal control unit 412.

The terminal control unit 412 controls processing in the portable terminal 410. For example, the terminal control unit 412 gives, to the wind velocity calculation unit 414, an air pressure value given by the air pressure measurement unit 111 and the temperature given by the temperature measurement unit 417. The terminal control unit 412 gives, to the air conditioning control determination unit 416, the temperature given by the temperature measurement unit 417 and the humidity given by the humidity measurement unit 418.

The wind velocity calculation unit 414 causes the storage unit 415 to store the air pressure value given by the terminal control unit 412. Based on the variation in a plurality of air pressure values stored in the storage unit 415, set values of a current wind direction and a current airflow volume of the air conditioner 230 given by the terminal communication unit 413, and the temperature given by the temperature measurement unit 417, the wind velocity calculation unit 414 calculates a wind velocity of wind received by the portable terminal 410 and specifies a presence direction of the portable terminal 410. The calculated wind velocity and the specified presence direction are given to the air conditioning control determination unit 416.

In this embodiment, the wind velocity calculation unit 414 uses an air density corresponding to the temperature given by the temperature measurement unit 417 to calculate a wind velocity by Equation (1) mentioned above.

The storage unit 415 stores information necessary for processing in the portable terminal 410. For example, the storage unit 415 stores an air pressure value given by the wind velocity calculation unit 414. The storage unit 415 stores density information in which the temperature and the air density are associated with each other. The wind velocity calculation unit 414 can specify an air density corresponding to the temperature given by the temperature measurement unit 417 by referring to the density information. The storage unit 415 stores sensible temperature information in which a combination of a wind velocity, a temperature, and a humidity is associated with a sensible temperature. The storage unit 415 can be implemented by a volatile memory or a nonvolatile memory.

The air conditioning control determination unit 416 specifies a sensible temperature by using the wind velocity given by the wind velocity calculation unit 414, the temperature given by the temperature measurement unit 417, and the humidity given by the humidity measurement unit 418. For example, the air conditioning control determination unit 416 specifies a sensible temperature corresponding to the wind velocity, the temperature, and the humidity by referring to the sensible temperature information stored in the storage unit 415.

Then, in accordance with the set values of the current wind direction and the current airflow volume, the presence direction given by the wind velocity calculation unit 414, and the specified sensible temperature, the air conditioning control determination unit 416 determines details of control on the wind direction and the airflow volume by the air conditioner 230. The details of control on the wind direction and the airflow volume are previously determined in accordance with a combination of the set values of the current wind direction and the current airflow volume, the presence direction, and the sensible temperature. The air conditioning control determination unit 416 gives the details of control on the wind direction and the airflow volume to the terminal communication unit 413.

The air conditioning control determination unit 416 determines the opening/closing degree of the opening/closing device 450 in accordance with the specified sensible temperature. The opening/closing degree is previously determined in accordance with the sensible temperature. The air conditioning control determination unit 416 gives the opening/closing degree to the terminal communication unit 413.

The terminal communication unit 413 transmits, to the air conditioner 230, details of control on the wind direction and the airflow volume given by the air conditioning control determination unit 416.

The terminal communication unit 413 transmits, to the opening/closing device 450, the opening/closing degree given by the air conditioning control determination unit 416.

Furthermore, the terminal communication unit 413 receives the set values of the current wind direction and the current airflow volume from the air conditioner 230, and gives the set values to the wind velocity calculation unit 414.

The opening/closing device 450 includes an opening/closing communication unit 451, an opening/closing control unit 452, and an opening/closing unit 453.

The opening/closing communication unit 451 communicates with the network 101. For example, the opening/closing communication unit 451 receives the opening/closing degree from the portable terminal 410, and gives the opening/closing degree to the opening/closing control unit 452.

In accordance with the opening/closing degree given by the opening/closing communication unit 451, the opening/closing control unit 452 controls the opening/closing unit 453 attached to an opening/closing target.

The opening/closing unit 453 is attached to the opening/closing target, and opens and closes the opening/closing target to obtain the opening/closing degree given by the opening/closing communication unit 451. In this embodiment, the opening/closing target is a hinged door, a shutter, a sliding door, or a window, for example.

As illustrated in FIG. 2A, for example, a part or whole of the opening/closing control unit 452 described above may be implemented by the memory 10 and the processor 11.

A part of the opening/closing control unit 452 may also be implemented by the processing circuit 12, as illustrated in FIG. 2), for example.

Figure 9:
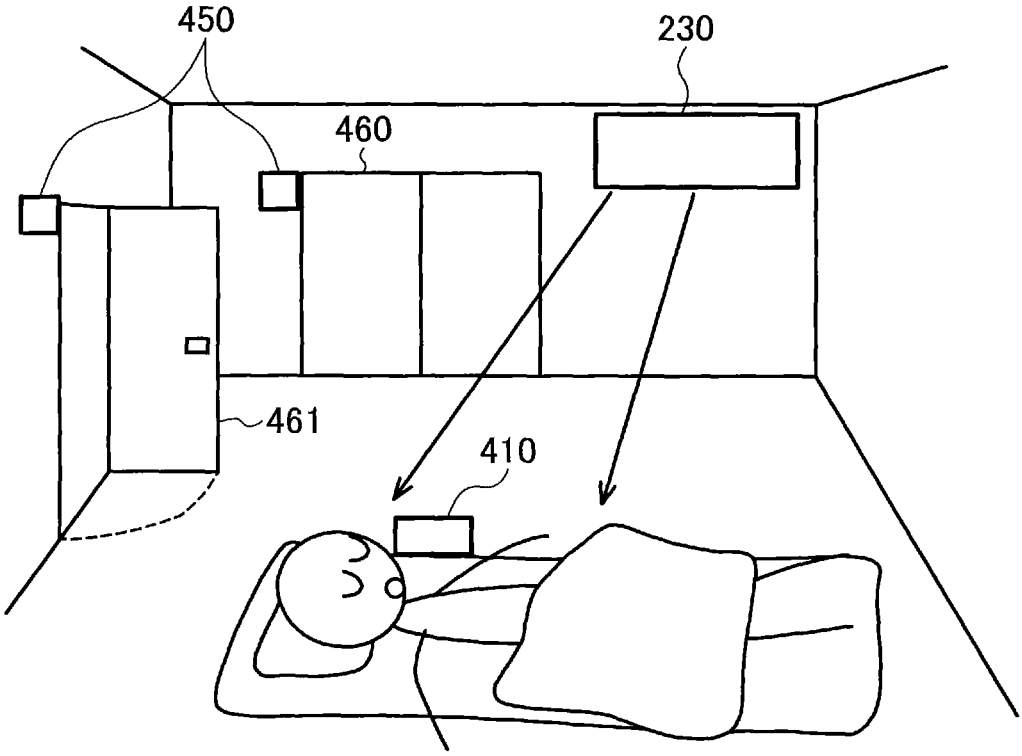
FIG. 9 is a schematic drawing illustrating a method for using the air conditioning control system according to the fourth embodiment.

FIG. 9 is a schematic drawing illustrating a method for using the air conditioning control system 400 according to the fourth embodiment.

The portable terminal 410 is placed next to a sleeping person, and receives wind from the air conditioner 230. At this time, the portable terminal 410 is preferably placed at a side of the person toward the air conditioner 230.

The opening/closing devices 450 are attached to a window 460 and a door 461, and open and close each of the window 460 and the door 461. A known configuration may be applied to the configuration of the opening/closing unit 453 for opening and closing the window 460, and thus, detailed description thereof will be omitted.

As described above, according to the fourth embodiment, since the air density varies depending on the temperature, a wind velocity can be more accurately estimated by measuring the temperature.

In the air conditioning control system 400 according to the fourth embodiment, a sensible temperature can be specified from a temperature, a humidity, and a wind velocity. Thus, control can be performed in accordance with the sensible temperature.

Although the portable terminal 410 includes the wind velocity calculation unit 414, the storage unit 415, and the air conditioning control determination unit 416 in the fourth embodiment, the fourth embodiment is not limited to this example. For example, the wind velocity calculation unit 414, the storage unit 415, and the air conditioning control determination unit 416 may be included in one of the air conditioner 230 and the opening/closing device 450, or may be included in each of the air conditioner 230 and the opening/closing device 450. In such a case, the portable terminal 410 can transmit the measured air pressure value, temperature, and humidity to one of or both of the air conditioner 230 and the opening/closing device 450.

In the case where the wind velocity calculation unit 414, the storage unit 415, and the air conditioning control determination unit 416 are included in one of the air conditioner 230 and the opening/closing device 450, the air conditioning control determination unit 416 determines details of control on the air conditioner 230 and the opening/closing device 450, and transmits the details of control on the other device to the other device.

In the case where the wind velocity calculation unit 414, the storage unit 415, and the air conditioning control determination unit 416 are included in each of the air conditioner 230 and the opening/closing device 450, the air conditioning control determination unit 416 determines details of control on its own device.

DESCRIPTION OF REFERENCE CHARACTERS

100, 200, 300, 400 air conditioning control system, 101 network, 110, 210, 410 portable terminal, 111 air pressure measurement unit, 112, 412 terminal control unit, 113, 413 terminal communication unit, 214, 414 wind velocity calculation unit, 215, 415 storage unit, 216, 416 air conditioning control determination unit, 417 temperature measurement unit, 418 humidity measurement unit, 130, 230, 330 air conditioner, 131 air conditioning communication unit, 132, 332 wind velocity calculation unit, 133 storage unit, 134, 334 air conditioning control determination unit, 135, 235 air conditioning control unit, 136 air conditioning unit, 450 opening/closing device, 451 opening/closing communication unit, 452 opening/closing control unit, 453 opening/closing unit.

What is claimed is:

1. An air conditioner to communicate with a portable terminal including an air pressure sensor to measure an air pressure value and to change a wind direction and an airflow volume, the air conditioner comprising:

a network interface card to receive a plurality of air pressure values from the portable terminal by communicating with the portable terminal; and processing circuitry to calculate a wind velocity of wind received by the portable terminal from a variation in the plurality of air pressure values received by the network interface card;

to specify a presence direction that is a direction in which the portable terminal is present with respect to the air conditioner;

to determine the wind direction and the airflow volume of the air conditioner in accordance with the wind velocity and the presence direction; and to control the air conditioner so that the determined wind direction and airflow volume are obtained.

2. An air conditioner to communicate with a portable terminal and to change a wind direction and an airflow volume, the portable terminal including an air pressure sensor to measure an air pressure value, a temperature sensor to measure a temperature, and a humidity sensor to measure a humidity, the air conditioner comprising:

a network interface card to receive a plurality of air pressure values, a temperature, and a humidity from the portable terminal by communicating with the portable terminal; and processing circuitry to calculate a wind velocity of wind received by the portable terminal from a variation in the plurality of air pressure values received by the network interface card;

to specify a presence direction that is a direction in which the portable terminal is present with respect to the air conditioner;

to specify a sensible temperature of a user of the portable terminal from the wind velocity, the temperature, and the humidity;

to determine the wind direction and the airflow volume of the air conditioner in accordance with the sensible temperature and the presence direction; and to control the air conditioner so that the determined wind direction and airflow volume are obtained.

3. An air conditioner to communicate with a portable terminal and to change a wind direction and an airflow volume, the portable terminal including a sound collector to output an output value indicating a noise amount, the air conditioner comprising:

a network interface card to receive an output value from the portable terminal by communicating with the portable terminal; and processing circuitry to specify a wind velocity of wind received by the portable terminal from a variation in a plurality of output values received by the network interface card;

to specify a presence direction that is a direction in which the portable terminal is present with respect to the air conditioner;

to determine the wind direction and the airflow volume of the air conditioner in accordance with the wind velocity and the presence direction; and to control the air conditioner so that the determined wind direction and airflow volume are obtained.

4. The air conditioner according to claim 1, wherein the processing circuitry specifies the variation by using a target difference that is a difference between a first air pressure value and a smallest value in a plurality of second air pressure values, the first air pressure value being measured by the air pressure sensor with a current wind direction and a current airflow volume of the air conditioner, the plurality of second air pressure values being measured a plurality of times by the air pressure sensor with a wind direction of the air conditioner being changed in a horizontal direction by the processing circuitry.

5. The air conditioner according to claim 4, further comprising a memory to store angle information and efficiency information, the angle information associating an angle at which wind hits the air pressure sensor with a difference between a maximum value and a minimum value in air pressure values measured by the air pressure sensor at the angle in a case where a wind direction of the air conditioner is changed in the horizontal direction by the processing circuitry, the efficiency information associating the angle with an efficiency that is a value obtained by dividing an air pressure value measured by the air pressure sensor at the angle by the maximum value in the air pressure values measured by the air pressure sensor in a case where the angle is changed, wherein the processing circuitry specifies an angle corresponding to the difference between the maximum value and the minimum value in the plurality of second air pressure values by referring to the angle information, specifies an efficiency corresponding to the specified angle by referring to the efficiency information, correct the target difference by dividing the target difference by the specified efficiency, and uses the corrected target difference as the variation.

6. The air conditioner according to claim 5, wherein the processing circuitry corrects the target difference in a case where wind from the air conditioner hits the air pressure sensor, and the processing circuitry does not correct the target difference and uses the target difference as the variation in a case where wind from the air conditioner does not hit the air pressure sensor.

7. The air conditioner according to claim 6, wherein the processing circuitry determines that wind from the air conditioner hits the air pressure sensor if the target difference is larger than a predetermined threshold and the plurality of second air pressure values include one local maximum value.

8. The air conditioner according to claim 1, wherein the processing circuitry calculates the wind velocity by using a square root of a value obtained by dividing a double of the variation by an air density.

9. The air conditioner according to claim 8, wherein the portable terminal further includes a temperature-sensor to measure a temperature, and the processing circuitry calculates the wind velocity by using the air density corresponding to the temperature.

10. The air conditioner according to claim 2, further comprising an opening/closing device including an opening/closing unit configured to open and closes a target, wherein the processing circuitry determines an opening/closing degree of the opening/closing device in accordance with the sensible temperature, and controls the opening/closing unit so that the determined opening/closing degree is obtained.

* * * * *